US006600458B1

(12) United States Patent
Welsh

(10) Patent No.: US 6,600,458 B1
(45) Date of Patent: Jul. 29, 2003

(54) MAGNETIC LOOP ANTENNA

(75) Inventor: Raphael Joseph Welsh, Pasadena, MD (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/001,447

(22) Filed: Oct. 31, 2001

(51) Int. Cl.[7] ..... H01Q 21/00
(52) U.S. Cl. ..... 343/867; 343/742
(58) Field of Search ..... 343/787, 788, 343/741, 742, 866, 867, 841

(56) References Cited

U.S. PATENT DOCUMENTS 2,399,382 A * 4/1946 Polydoroff ..... 343/788
5,281,941 A * 1/1994 Bernstein ..... 336/188
5,835,066 A * 11/1998 Kropielnicki et al. ..... 343/704
6,163,305 A * 12/2000 Murakami et al. ..... 343/788

OTHER PUBLICATIONS

Cross–sectional View of an ELF/VLF Magnetic Loop Antenna with Each Winding Wound Around Different Turns Areas, Jan. 5, 1999.

* cited by examiner

*Primary Examiner*—Hoang Nguyen
(74) *Attorney, Agent, or Firm*—Baker Botts L.L.P.

(57) ABSTRACT

An antenna operable to collect sub-high frequency radio signals includes a first winding disposed outwardly from a three dimensional support structure and wound around a first axis of the three dimensional support structure. The antenna further includes a second winding disposed outwardly from the three dimensional support structure and the first winding and wound around a second axis orthogonal to the first axis of the three dimensional support structure. In one embodiment, the first winding and the second winding each include an approximately equal turns area.

37 Claims, 3 Drawing Sheets

MAGNETIC LOOP ANTENNA

TECHNICAL FIELD OF THE INVENTION

This invention relates in general to the field of communications systems and, more specifically, to a magnetic antenna capable of collecting frequency emissions.

BACKGROUND OF THE INVENTION

Magnetic antennae used, for example, by the intelligence community collect frequency emissions from "areas-of-interest" including machinery and equipment used in underground and above ground facilities. Fabrication of conventional magnetic antennae is such that each winding in a three dimensional structure is wound around a different turns area. In an effort to create approximately equal turns-area ratios between the windings, conventional techniques typically require using a different number of turns in each winding. Attempting to match turns-area ratios by using unequal numbers of turns in the windings is difficult and inaccurate. Moreover, a change in the number of turns wound around a given turns area causes the impedance in each winding to differ. Counteracting this effect typically requires the placement of a resistive element in each winding. This overall process leads to increased expense and processing time and still does not ensure balanced induced fields within the magnetic antenna.

SUMMARY OF THE INVENTION

The present invention recognizes a need for an improved method and apparatus for collecting frequency emissions. In accordance with the present invention, a method and apparatus for collecting sub-high frequency radio emissions is provided that reduce or eliminate at least some of the shortcomings associated with prior approaches.

In one aspect of the invention, an antenna device operable to collect sub-high frequency radio signals comprises a three dimensional support structure. A first winding is disposed outwardly from the three dimensional support structure and wound around a first axis of the three dimensional support structure. The antenna further comprises a second winding disposed outwardly from the three dimensional support structure and the first winding and wound around a second axis orthogonal to the first axis of the three dimensional support structure. In one particular embodiment, the first winding and the second winding each comprise an approximately equal turns area.

In another aspect of the invention, a method of forming an antenna operable to collect sub-high frequency radio signals comprises forming a first winding disposed outwardly from a three dimensional support structure and wound around a first axis of the three dimensional support structure. The method further comprises forming a second winding disposed outwardly from the three dimensional support structure and the first winding and wound around a second axis orthogonal to the first axis of the three dimensional support structure. In one particular embodiment, the first winding and the second winding each comprise an approximately equal turns area.

Depending on the specific features implemented, particular embodiments of the present invention may exhibit some, none, or all of the following technical advantages. Various aspects of the invention create an approximately equal turns area in at least two of the plurality of substantially orthogonal windings, which enables the formation of approximately balanced induced fields in those windings using a substantially similar number of turns in each winding. Various embodiments of the present invention facilitate the creation of a filter shield with approximately equal inductance in each filter circuit.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention, and for further features and advantages thereof, reference is now made to the following description taken in conjunction with the accompanying drawings, in which.

DETAILED DESCRIPTION OF THE INVENTION

Figure 1:
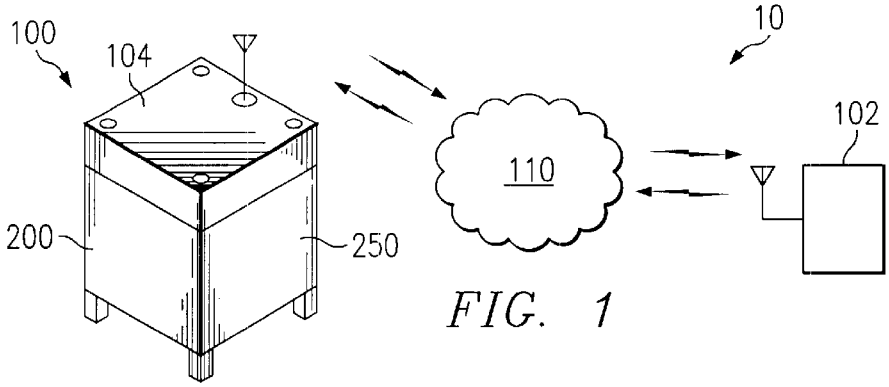
FIG. 1 is a block diagram of one embodiment of a communications system including a magnetic loop antenna constructed according to the teachings of the present invention.

FIG. 1 is a block diagram of one embodiment of a communications system 10 including a magnetic loop antenna 100. In this example, magnetic loop antenna 100 includes a magnetic sensor 200 operable to collect signals within a desired frequency range, a filter shield 250 coupled to magnetic sensor 200 and operable to selectively block unwanted frequency signals, and a data collections unit 104 operable to condition signals received from magnetic sensor 200 for communication to devices remote from magnetic loop antenna 100. In particular embodiments, magnetic loop antenna 100 communicates with one or more communications devices 102 over a communications link 110.

Magnetic sensor 200 may comprise a plurality of substantially orthogonal windings, where at least one of the windings is wound around at least a portion of another winding. Magnetic sensor 200 collects frequency emissions, for example, sub-high frequency radio emissions. In this particular embodiment, magnetic sensor 200 operates to collect frequencies ranging from 1 Hz to 8000 Hz. Although magnetic sensor 200 collects relatively low frequencies in this example, other frequency ranges can be collected without departing from the scope of the present invention.

Collection of the sub-high frequency radio signals at the windings of magnetic sensor 200 creates an induced field within each of the plurality of orthogonal windings. In one embodiment, magnetic sensor 200 can produce balanced induced fields within each of the plurality of windings, for example, by maintaining an approximately equal turns area in at least two of the plurality of substantially orthogonal windings. The "turns area" of a winding is the area around which each of the plurality of substantially orthogonal windings is wound.

Filter shield 250 attenuates at least a portion of the signals collected by magnetic sensor 200 having frequencies outside a desired frequency range. Filter shield 250 may comprise any appropriate frequency dependent attenuation device. Where, for example, magnetic sensor 200 operates to collect relatively low frequency signals, filter shield 250 could comprise a low-pass filter operable to substantially block higher frequency signals. In one particular embodiment, filter shield 250 may attenuate the signals collected by magnetic sensor 200 having frequencies above 20,000 Hz. The corner frequency of filter shield 250, however, could be set at any desired frequency. In one particular embodiment, filter shield 250 is disposed outwardly from and surrounds magnetic sensor 200. In that embodiment, filter shield 250 may comprise, for example, a plurality of substantially orthogonal shorted turns or a plurality of substantially orthogonal shield windings residing outwardly from magnetic sensor 200.

Data collections unit 104 receives the induced field generated in the windings of magnetic sensor 200 and prepares the received signals for communication from magnetic loop antenna 100. In one embodiment, data collections unit 104 can transmit sub-high frequency radio signals through communications link 110 to remote communications device 102. Transmission of the sub-high frequency radio signals may be by any communications technology, for example, in a circuit switched format or a packet switched format, and may exist in an optical format or an electric format. In some embodiments, data collections unit 104 may receive control signals through communications link 110 from remote communications device 102 to affect the mode of operation of magnetic loop antenna 100.

Communications link 110 may comprise a direct link, or any public, private, or combination of public and private networks. For example, communications link 110 could comprise a data network, a public switched telephone network (PSTN), an integrated services digital network (ISDN), a local area network (LAN), a wide area network (WAN), or other communication systems or combination of communication systems at one or more locations. Communications link 110 may comprise a wireless network, a wireline network, or a combination of wireless and wireline networks communicating using optical and/or electrical formats. One or more remote communications devices 102 may couple to communications link 110.

Each remote communications device 102 may comprise any of a variety of communications or computation devices. For example, remote communications device 102 could comprise a workstation, a mainframe computer, a miniframe computer, a desktop computer, a laptop computer, a personal digital assistant, or any other computing or communicating device. In operation, remote communications device 102 may execute with any of the well-known MS-DOS, PC-DOS, OS-2, MAC-OS, WINDOWS™, UNIX, or other appropriate operating systems.

Accurate collection of sub-high frequency radio signals typically depends on generating approximately balanced induced fields between each winding of magnetic sensor 200. Balanced induced fields can be achieved between two windings where, for example, the turns-area ratios of the windings are approximately equal. The "turns-area ratio" of a winding is the ratio of the turns area to the number of turns in the winding.

One aspect of the present invention recognizes a shortcoming associated with conventional fabrication techniques for magnetic loop antenna. In particular, those fabrication techniques typically result in magnetic loop antennae that contain different turns areas in each winding of the magnetic sensor. Forming an approximately equal turns-area ratio in the conventional magnetic loop antenna, therefore, generally requires compensating for the changes in turns area by using a different number of turns in each winding. Attempting to match turns-area ratios by using unequal numbers of turns in the windings is difficult and inaccurate. Moreover, a change in the number of turns wound around a given turns area causes the impedance in each winding to differ. To counteract this effect, conventional magnetic loop antennae generally require the placement of a resistive element in each winding. This leads to increased expense and processing time and still does not ensure balanced induced fields.

Unlike magnetic sensors in conventional cubic magnetic loop antennae, magnetic sensor 200 comprises an approximately equal turns area in at least two of the plurality of substantially orthogonal windings in magnetic sensor 200. An approximately equal turns area in at least two of the plurality of orthogonal windings in magnetic sensor 200 provides an advantage of maintaining an equal number of turns wound around the turns area of each winding, which creates an approximately equal turns-area ratio in each of the two windings. This facilitates production of approximately balanced induced fields between each of the windings without requiring insertion of additional resistive elements. Of course, the mere presence of an additional resistive element associated with the winding does not remove a device from the scope of this invention, providing the device comprises a substantially equal turns area in at least two windings.

In operation, magnetic loop antenna 100 collects signals and prepares the collected signals for communication from magnetic loop antenna 100. Antenna 100 transmits the collected signals to devices remote from magnetic loop antenna 100. In this example, magnetic loop antenna 100 includes magnetic sensor 200 operable to collect at least sub-high frequency radio signals. Magnetic sensor 200 comprises at least two windings having substantially equal turns areas and, therefore, substantially equal turns-area ratios using approximately the same number of turns per winding.

Filter shield 250 is coupled to magnetic sensor 200 and operates to attenuate unwanted frequencies collected by magnetic sensor 200. Data collections unit 104 receives the desired frequency range of signals from magnetic sensor 200 and prepares the received signals for communication from magnetic loop antenna 100.

In particular embodiments, magnetic loop antenna 100 communicates with one or more communications devices 102 over communications link 110. In some embodiments, magnetic loop antenna 100 operates to receive control signals through communications link 110 from communications device 102 and to affect the mode of operation of magnetic loop antenna 100.

Figure 2:
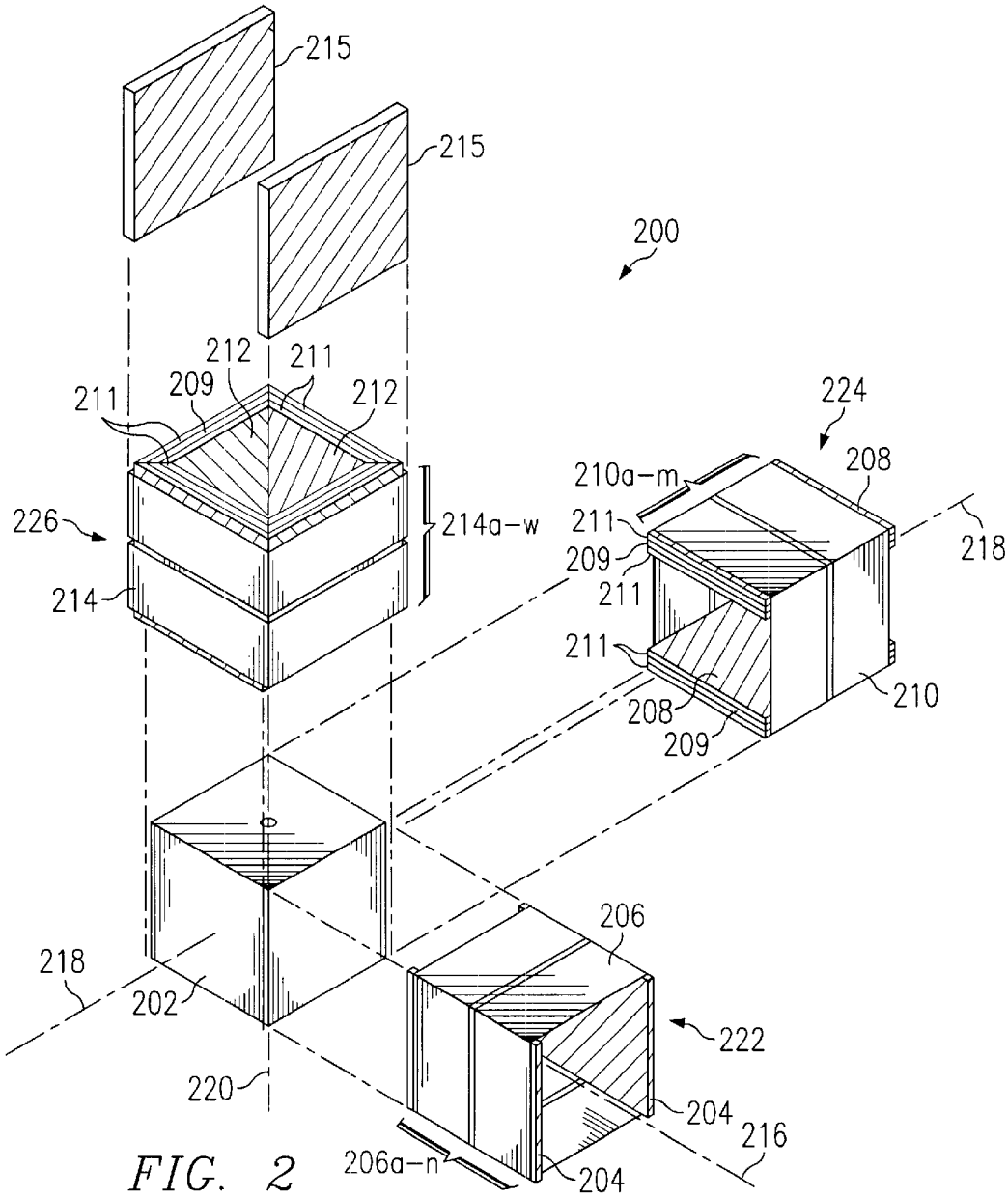
FIG. 2 is an exploded view showing one exemplary method of forming a magnetic sensor according to the teachings of the present invention.

FIG. 2 is an exploded view showing one exemplary method of forming a magnetic sensor, in this example magnetic sensor 200. Antenna 100 includes a three dimensional support structure 202 that directly or indirectly supports the windings of magnetic sensor 200. Support structure 202 may comprise for example a substantially cubic shape. Structures having an approximately cubic shape having dimensions within twenty percent of.one another are substantially cubic. Support structure 202 may comprise any material capable of supporting a winding strategy. For example, support structure 202 may comprise foam, styrofoam, or a skeleton structure forming an approximately cubic shape. To avoid interference with the windings, support structure 202 can be formed of or surrounded by a substantially non-conductive material.

The size of support structure 202 can be selected, for example, based on the desired sensitivity of magnetic sensor 200. In that case, determining the size of support structure 202 involves a determination of the turns area and the number of turns wound around the turns area. In this particular embodiment, support structure comprises a twelve-inch by twelve-inch by twelve-inch cubic form. Other dimensions could be used without departing from the scope of the present invention.

A first winding structure 222 is formed around first axis 216 of antenna 100 outwardly from support structure 202. Although first winding structure 222 can be, chronologically, the first winding structure formed, it need not be. The term "first winding" is not intended to require any particular temporal arrangement in the formation of magnetic loop antenna 100. In this example, first winding structure 222 comprises a first winding 206 wound a number of turns $\mathbf{206}_{a\text{-}n}$ around a first plurality of spacers 204 disposed inwardly from at least two opposing sides of first winding 206.

First winding 206 may comprise any conductive material capable of collecting the desired signals. The conductive material may comprise any size and type of conductive material capable of achieving the desired sensitivity of magnetic sensor 200. In this particular example, the conductive material comprises 18 AWG laminated copper wire. Laminated wire provides an advantage of preventing the formation of shorts between each turn of wire.

Turns $\mathbf{206}_{a\text{-}n}$ may comprise any number of turns wound around the turns area of first winding 206 capable of collecting a desired frequency range and achieving a desired sensitivity of magnetic sensor 200. The sensitivity of magnetic sensor 200 and its ability to collect particular frequency ranges depends, at least in part, on the turns area of the winding and the number of turns wound around the turns area. In this particular embodiment, first number of turns $\mathbf{206}_{a\text{-}n}$ comprises 280 turns.

In one embodiment, the ends of first winding 206 are coupled to a transmission medium 418 capable of transmitting the signal collected by first winding 206 to data collections unit 104. Transmission medium 418 may comprise any communication medium. In one embodiment, transmission medium 418 may comprise a cable containing at least one inner conductor and at least one outer shield conductor. For example, transmission medium 418 may comprise a twinax transmission line or a co-axial cable. In this particular embodiment, at least one end of first winding 206 is coupled to at least one inner conductor of transmission medium 418.

A first plurality of spacers 204 are disposed inwardly from first winding 206. Spacers 204 can comprise any material capable of providing substantially constant spacing between first winding 206 and a structure disposed immediately inwardly from spacers 204. To avoid interference with the windings, spacers 204 can be formed of or surrounded by substantially non-conductive material. For example, spacers 204 may comprise sheets of foam board having a thickness of approximately one-half inch. Although spacers 204 in this example comprise sheets, spacers 204 could comprise another structure without departing from the scope of the present invention.

In the illustrated embodiment of first winding structure 222, spacers 204 reside on two opposing sides of support structure 202 perpendicular to second axis 218. Spacers 204 may be coupled to support structure 202 by any suitable mechanism, such as an adhesive or by fasteners.

In this example, the turns area of first winding 206 is defined by the combination of dimensions of first plurality of spacers 204 and support structure 202. In this particular embodiment, turns area of first winding 206 comprises a rectangular area of approximately twelve inches by thirteen inches. First winding 206 is wound around that turns area.

In an alternative embodiment, first winding structure 222 may be formed by excluding first plurality of spacers 204. In that embodiment, first winding structure 222 comprises first winding 206 wound directly around support structure 202. In that case, support structure 202 comprises a rectangular shape with, for example, a twelve inch by thirteen inch turns area.

A second winding structure 224 is formed around a second axis 218 of antenna 100. In this example, second winding structure 224 comprises a second winding 210 wound a number of turns $\mathbf{210}_{a\text{-}m}$ around a second plurality of spacers 208. Spacers 208 are disposed inwardly from at least two opposing sides of second winding 210. The structure and function of second winding 210 can be substantially similar to first winding 206. In this particular embodiment, number of turns $\mathbf{206}_{a\text{-}n}$ of first winding 206 and number of turns $\mathbf{210}_{a\text{-}m}$ of second winding 210 comprise an approximately equal number of turns of similar conductive materials, an approximately equal turns area, and are connected to substantially similar transmission media 418 and 420, respectively. Turns areas having equal dimensions or dimensions at least within ten percent of one another are approximately equal turns areas.

A second plurality of spacers 208 are disposed inwardly from second winding 210. Spacers 208 can comprise any material capable of providing substantially constant spacing between second winding 210 and first winding structure 222, which in this example is disposed immediately inwardly from spacers 208. To avoid interference with the windings, spacers 208 can be formed of or surrounded by substantially non-conductive material.

In the illustrated embodiment, spacers 208 comprise a material capable of reducing cross-talk between first winding 206 and second winding 210, while substantially avoiding attenuation of the signals collected by first winding 206. For example, each of spacers 208 may comprise a metal decoupling sheet residing between two sheets of foam board. In this particular embodiment, each of the spacers 208 comprises a thin metallic decoupling sheet 209 residing between two one-quarter inch foam boards 211. As a particular example, metallic decoupling sheet 209 may comprise a nickel coating with a thickness of approximately 3000 Angstroms. In this example, each of the spacers 208 comprises a total thickness of approximately one-half inch.

In some embodiments, metallic decoupling sheet 209 residing within each of spacers 208 is coupled to a transmission medium 420 capable of grounding decoupling sheet 209. Grounding decoupling sheet 209 provides an advantage of preventing the formation of a capacitive coupling between first winding 206 and second winding 210. In this particular embodiment, second transmission medium 420 comprises a communications medium comprising at least one outer shield conductor. In that example, the decoupling sheet can be coupled to the outer shield conductor and the outer shield conductor can be coupled to ground.

Second winding structure 224 is formed outwardly from first winding structure 222 around second axis 218 of antenna 100. Second axis 218 is substantially orthogonal to first axis 216. In one embodiment of second winding structure 224, spacers 208 reside outwardly from two opposing sides of first winding 206 and inwardly from two opposing sides of second winding 210, where first winding 206 and second winding 210 overlap. In the illustrated embodiment, spacers 208 reside outwardly from two opposing sides of first winding 206 perpendicular to third axis 220. Spacers 208 may be coupled to first winding 206 by any suitable mechanism, such as an adhesive or by fasteners. In some embodiments, intermediate structures may reside between first winding 206 and spacers 208 or between spacers 208 and second winding 210.

In this example, the turns area of second winding 210 is defined by the combination of dimensions of first winding 206 and second plurality of spacers 208. In this particular embodiment, turns area of second winding 210 comprises a rectangular area of approximately twelve inches by thirteen inches. In that embodiment, The turns area of first winding 206 and second winding 210 are approximately equal. Second winding 210 is wound around that turns area.

A third winding structure 226 is formed around a third axis 220 of antenna 100. In this example, third winding structure 226 comprises a third winding 214 wound a number of turns $\mathbf{214}_{a\text{-}w}$ around a third plurality of spacers 212 and a fourth plurality of spacers 215. In this example, third plurality of spacers 212 are disposed inwardly from four sides of third winding 214, where third winding 214 overlaps first winding 206 and second winding 210. In that example, fourth plurality of spacers 215 are disposed inwardly from two opposing sides of third winding 214 where third winding 214 and second winding overlap.

The structure and function of third winding 214 can be substantially similar to first winding 206 and second winding 210. In this particular embodiment, first winding 206, second winding 210, and third winding 214 each comprise an equal number of turns of a similar conductive material and are coupled to substantially similar transmission media 418, 420, and 422.

In this example, the structure and function of third plurality of spacers 212 can be substantially similar to second plurality of spacers 208. In this particular embodiment, each of the second plurality of spacers 208 and third plurality of spacers 212 comprises a thin metallic decoupling sheet 209 residing between two one-quarter inch foam boards 211. In this example, each of metallic decoupling sheets 209 is coupled to the outer shield conductor of its respective transmission medium 420 or 422. In this example, the structure and function of fourth plurality of spacers 215 can be similar to first plurality of spacers 204. As a particular example, each of the spacers 212 and spacers 215 could comprise a total thickness of approximately one-half inch.

In this embodiment, third winding structure 226 is formed outwardly from second winding structure 224 around third axis 220. Third axis 220 is substantially orthogonal to first axis 216 and second axis 218. In one embodiment, spacers 212 reside outwardly from two opposing sides of first winding 206 and outwardly from two opposing sides of second winding 210, where third winding 214 overlaps first winding 206 and second winding 210. In that embodiment, spacers 215 reside outwardly from two opposing sides of spacers 212, where third winding 214 overlaps second winding 210.

In the illustrated embodiment of third winding structure 226, spacers 212 reside outwardly from two opposing sides of first winding 206 perpendicular to second axis 218 and outwardly from two opposing sides of second winding 210 perpendicular to first axis 216. In that embodiment, spacers 215 reside outwardly from two opposing sides of spacers 212 perpendicular to first axis 216. Spacers 212 and spacers 215 may be coupled by any suitable mechanism, such as an adhesive or by fasteners. In some embodiments, intermediate structures may reside between second winding 210 and spacers 212, between spacers 212 and spacers 215, between spacers 212 and third winding 214, or between spacers 215 and third winding 214.

In this example, the turns area of third winding 214 is defined by the combination of dimensions of second winding 210, third plurality of spacers 212, and fourth plurality of spacers 215. In this particular embodiment, turns area of third winding 214 comprises a square area of approximately fourteen inches by fourteen inches. Third winding 214 is wound around that turns area. In this example, number of turns $\mathbf{214}_{a\text{-}w}$ is approximately equal to number of turns $\mathbf{206}_{a\text{-}n}$ and number of turns $\mathbf{210}_{a\text{-}m}$.

The turns-area ratio of third winding 214, in this example, is larger than the turns-area ratios of first winding 206 and second winding 210. The turns-area ratio of third winding 214 will, however, be effectively reduced by an electronics enclosure 500 coupled within magnetic antenna 100. Electronics enclosure 500 has the effect of proportionally reducing the effective collection area of third winding 214 and, thus, reducing the effective turns-area ratio of third winding 214.

In an alternative embodiment, third winding structure 226 may be formed by excluding fourth plurality of spacers 215. In that embodiment, third winding structure comprises third winding 214 wound around a third plurality of spacers 212 disposed inwardly from four sides of third winding 214. In this example, each of spacers 212 disposed perpendicular to first axis 216 comprises a total thickness of approximately one inch and each of spacers 212 disposed perpendicular to second axis 218 comprises a total thickness of approximately one-half inch. In this particular embodiment, the turns area of third winding 214 comprises a square area of approximately fourteen inches by fourteen inches.

Winding structures 222, 224, and 226 can be formed in any order around any axes 216, 218, or 220 without departing from the scope of the present invention. In the illustrated embodiment, first winding structure 222 and second winding structure 224 are formed around perpendicular horizontal planes. Forming two winding structures with approximately equal turns areas in the horizontal plane enables accurate collection of the horizontal component of the signal collected by antenna 100.

In the illustrated example, first axis 216 and second axis 218 are located in perpendicular horizontal planes, and third axis 220 is located in the vertical plane. The axes 216, 218, and 220 can be located in any plane without departing from the scope of the present invention.

In the illustrated embodiment, two orthogonal windings having substantially equal turns areas are formed inwardly from a third orthogonal winding. In an alternative embodiment, the orthogonal windings having substantially equal turns areas could be formed outwardly from a previously formed inner winding having a slightly different physical turns area. In that embodiment, third winding structure 226 could be wound around support structure 202. A plurality of spacers could be positioned outwardly from winding 206 and support structure 202 so that the combination of the spacers and support structure 202 form an approximately cubic structure. Windings 206 and 210 could then be formed outwardly from winding 214 and its associated spacers substantially as described above.

Figure 3:
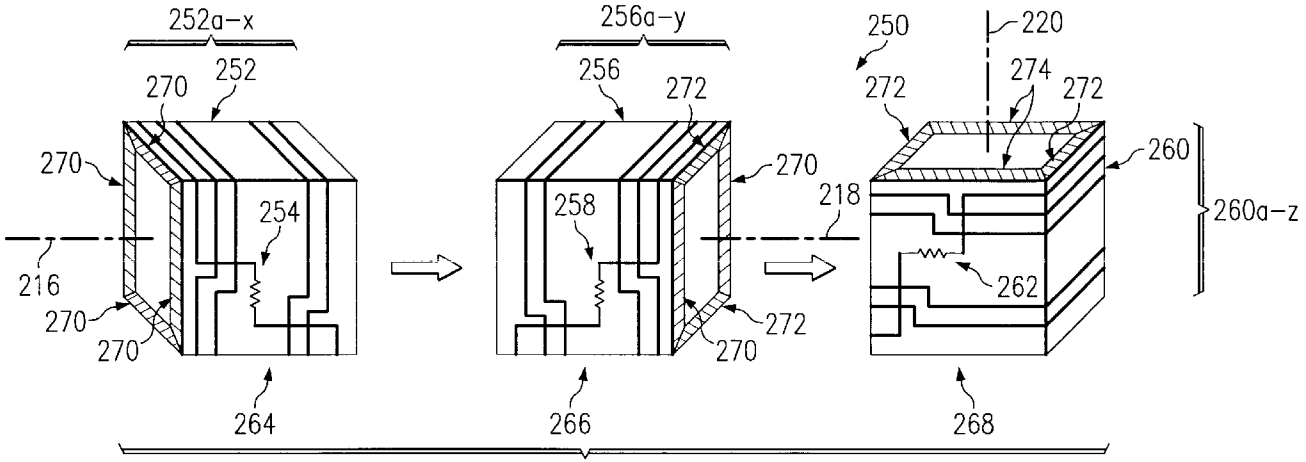
FIG. 3 is an exploded view showing one exemplary method of forming a filter shield according to the teachings of the present invention.

FIG. 3 is an exploded view showing one exemplary method of forming filter shield 250. Filter shield 250 is coupled to magnetic sensor 200 and operates to attenuate unwanted frequencies. Attenuation of unwanted frequencies in filter shield 250 typically involves creating filter circuits with approximately equal inductance.

The filter circuits of conventional filter shields comprise a plurality of substantially orthogonal shorted turns, each comprising a stainless steel sheet soldered together at the ends. Calculating the inductance of each shorted turn was difficult and generally resulted in filter shields with unequal inductance in each shorted turn. Counteracting this effect required experimentation and subsequent modification of each shorted turn. This lead to increased expense and processing time and still did not ensure an approximately equal inductance in each shorted turn.

To reduce these effects, the filter circuits of filter shield 250 comprise a plurality of substantially orthogonal shield windings. A plurality of substantially orthogonal shield windings in filter shield 250 provides an advantage of enabling accurate calculation of the inductance within each shield winding, which enables the creation of shield windings that have approximately equal attenuation frequencies.

The illustrated embodiment provides one method of forming filter shield 250. A first shield winding structure 264 is formed around first axis 216 of antenna 100 outwardly from magnetic sensor 200. Although first shield winding structure 264 can be, chronologically, the first shield winding formed, it need not be. The term "first shield winding" is not intended to require any particular temporal arrangement in the formation of antenna 100. In this example, first shield winding structure 264 comprises a first shield winding 252 wound a number of turns $\mathbf{252}_{a\text{-}x}$ around a plurality of spacers 270.

First shield winding 252 may comprise any circuit capable of creating a desired shield winding inductance. The inductance of each shield winding contributes to determining the attenuating characteristics of filter shield 250. The inductance of each shield winding depends, at least in part, on the size and type of conductive material, the number of turns of the shield winding, and the characteristics of any resistive element within the circuit. In this example, first shield winding 252 comprises a conductive material whose ends are coupled to a first resistive element 254.

First shield winding 252 may comprise any conductive material. In this particular example, the conductive material comprises ⅜ inch copper tape.

First shield winding 252 may comprise any number of turns wound around the turns area of first shield winding 252 capable of creating at least a portion of the desired shield winding inductance. In this particular example, the fourth number of turns $\mathbf{252}_{a\text{-}x}$ comprises 10 turns.

Resistive element 254 may comprise any device whose characteristics ensure first shield winding 252 achieves its desired inductance. In this example, resistive element 254 comprises a 3.6-ohm resistor.

In this example, spacers 270 are disposed outwardly from all sides of magnetic sensor 200. The structure and function of spacers 270 can be substantially similar to first plurality of spacers 204. In this particular embodiment, each of the spacers 270 comprises a sheet of foam board. Although spacers 270 in this example comprise sheets, spacers 270 could comprise another structure without departing from the scope of the present invention. In this example, each of the spacers 270 comprises a thickness of approximately one-quarter inch.

In the illustrated embodiment, first shield winding structure 264 comprises a first insulating layer 272 disposed outwardly from shield winding 252. First insulating layer 272 can comprise any material capable of insulating first shield winding 252 from other shield windings. For example, first insulating layer 272 may comprise a plastic insulating layer.

A second shield winding structure 266 is formed outwardly from first shield winding structure 264 around second axis 218 of antenna 100. Second axis 218 is substantially orthogonal to first axis 216. In this example, second shield winding structure 266 comprises a second shield winding 256 wound a number of turns $\mathbf{252}_{a\text{-}y}$ around at least a portion of first insulating layer 272. As a particular example, second shield winding 256 is disposed outwardly from first insulting layer 270 and wound around two opposing sides of first insulating layer 272 where first shield winding structure 264 and second shield winding structure 266 overlap. In the illustrated embodiment, second shield winding structure 266 comprises a second insulating layer 274 disposed outwardly from second shield winding 256.

The structure and function of second shield winding 256 and second insulating layer 274 can be substantially similar to the structure and function of first shield winding 252 and first insulating layer 272, respectively. In this example, first shield winding 252 and second shield winding 256 comprise a substantially equal number of turns of a similar conductive material, and are coupled to resistive elements having similar characteristics.

Third shield winding structure 268 is formed outwardly from second shield winding structure 266 around third axis 220 of antenna 100. Third axis 220 is substantially orthogonal to first axis 216 and second axis 218. In this example, third shield winding structure 268 comprises a third shield winding 260 wound a number of turns $\mathbf{260}_{a\text{-}z}$ around first insulating layer 272 and second insulating layer 274. In that example, third shield winding 260 is wound around two opposing sides of first insulating layer 272 and two opposing sides of second insulating layer 274 where third shield winding structure 268 overlaps first shield winding structure 264 and second shield winding structure.

The structure and function of third shield winding 260 can be substantially similar to first shield winding 252 and second shield winding 256. In this example, first shield winding 252, second shield winding 256, and third shield winding 260 comprise a substantially equal number of turns of a similar conductive material and are coupled to resistive elements having similar characteristics.

Shield winding structures 264, 266, and 268 can be formed in any order around any axes 216, 218, or 220 without departing from the scope of the present invention. In the above example, the description of forming particular shield windings 264, 266, and 268 around particular axes 216, 218, and 220 was for ease of description only.

Figure 4:
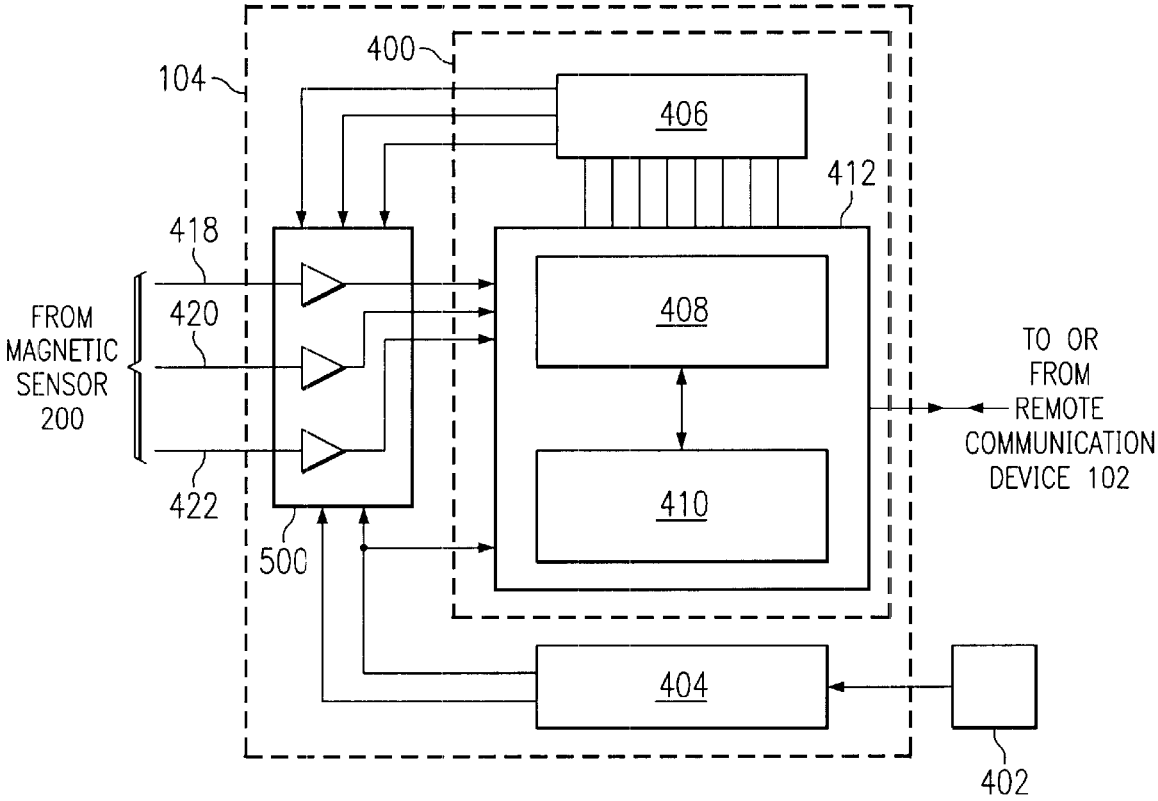
FIG. 4 is a block diagram of one example embodiment of a data collections unit constructed according to the teachings of the present invention.

FIG. 4 is a block diagram of one embodiment of data collections unit 104. In this example, data collections unit 104 includes an electronics enclosure 500 operable to condition the signals received from magnetic sensor 200 for communication from antenna 100. Electronics enclosure 500 may comprise a plurality of substantially similar signal conditioning channels coupled to magnetic sensor 200 and capable of conditioning the signals received from magnetic sensor 200 for communication from antenna 100 by communications module 400. In this example, electronics enclosure 500 operates to communicate a substantially flat output response as a function of input frequency, for example, communicating a substantially flat output response from input frequencies of approximately 80 Hz and above. Other output responses can be communicated without departing from the scope of the present invention.

In the illustrated example, data collections unit 104 includes a communications module 400 coupled to electronics enclosure 500 and operable to communicate the conditioned signals to devices remote from magnetic antenna 100. Communications module may comprise a transmitter device 412 capable of communicating the conditioned signals to one or more remote communication devices 102. In other embodiments, transmitter device 412 may comprise a transceiver device, or separate transmitter and receiver devices, capable of transmitting signal to and receiving signals from one or more remote communication devices 102. In this example, transmitter device 412 comprises a data acquisition card 408 capable of digitizing the conditioned signal and a wireless transceiver 410 capable of communicating the conditioned signal in Internet Protocol format to communications device 102. The conditioned signals may be communicated in any appropriate wireless or wireline communications format without departing from the scope of the present invention. For example, communication may be by cell phone, ATM, frame relay, or by any other communications format.

In some embodiments, transmitter device 412 may receive control signals through communications link 110 from remote communications device 102. Communications link 110 and communications device 102 are discussed above. In this example, transmitter device 412 comprises a wireless transceiver 410 operable to receive control signals from communications device 102 and communicate the control signal to a device capable of controlling the mode of operation of antenna 100. Control signals received by device 412 may be in any appropriate communications technology. For example, communication may be in a circuit switched format or a packet switched format, and may reside in an optical format or an electric format.

In some embodiments, transmitter device 412 may comprise wireless transceiver 410 operable to receive control signals from communications device 102 and data acquisition card 408 operable to communicate control signals to a control module 406 of communications module 400. In that embodiment, data acquisition card 408 comprises any electrical device with input/output functionality and capable of transmitting control signals to control module 406. In this particular example, data acquisition card 408 comprises a data acquisition card available from National Instruments.

Control module 406 may comprise any hardware, software, firmware, or combination thereof operable to affect a mode of operation of magnetic loop antenna 100. In one particular example, control module 406 comprises a field programmable gate array and support circuitry capable of decoding eight input/output lines.

In some embodiments, control module 406 may communicate the control signals received from transmitter device 412 to electronics module 500 to affect the mode of operation of antenna 100. Where, for example, it is initially desirable to place antenna 100 in an environment consisting of power lines, control module may transmit a control signal received from transmitter device 412 to electronics module 500 placing antenna 100 in notch filter mode. In notch filter mode antenna 100 substantially attenuates frequency signals attributable to the power lines (e.g., 50 Hz or 60 Hz) and passes the desired frequencies. Subsequently, if it is desired to place antenna 100 in an environment free of power lines, control module 406 may transmit a control signal received from transmitter device 412 to electronics module 500 removing antenna 100 from notch filter mode. Selectively bypassing a notch filer, placing magnetic antenna 100 in sleep mode, and changing the gain characteristics in the signal conditioning channels are just a few examples of affecting the mode of operation through use of control signals.

In the illustrated embodiment, data collections unit 104 includes an internal power source 404 capable of supplying power to antenna 100. Internal power source 404 may comprise, for example, a direct current power source coupled to electronics module 500. In some embodiments, internal power source 404 may comprise a rechargeable power source. In this example, internal power source 404 comprises a rechargeable lithium ion polymer battery pack coupled to electronics module 500 and communications module 400.

In another embodiment, internal power source 404 may comprise a voltage regulator coupled to internal power source 404 and capable of preserving power for different modes of operation. In this particular example, internal power source 404 comprises a voltage regulator capable of receiving a control signal from control module 406 and operable to place antenna 100 into sleep mode.

In the illustrated embodiment, data collections unit 104 includes an external power source 402 operable to provide long-term operation of antenna 100. External power source 402 may comprise, for example, a direct current or an alternating current power source coupled directly or indirectly through a transformer to internal power source 404. External power source 402 is operable to recharge internal power source 404. As particular examples, external power source 402 may comprise a solar power source or a thermal electric generation power source.

Figure 5:
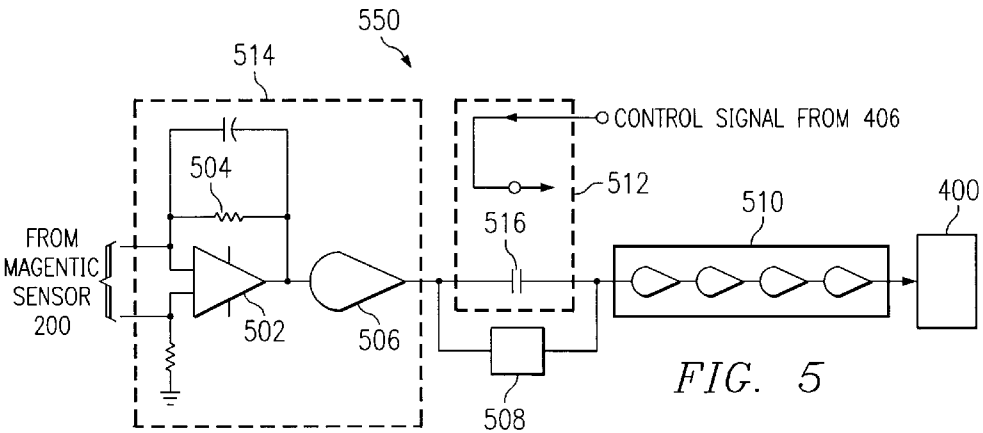
FIG. 5 is a block diagram showing one example embodiment of a signal conditioning channel operable to prepare the signals received from magnetic sensor for communication from magnetic loop antenna according to the teachings of the present invention.

FIG. 5 is a block diagram showing one embodiment of a signal conditioning channel 550 operable to condition the signals received from magnetic sensor 200 for communication from magnetic loop antenna 100. In this example, signal conditioning channel 550 includes a front end 514 coupled to the windings of magnetic sensor 200 and operable to produce a substantially flat output response, a notch filter 508 coupled to front end 514 and operable attenuate an undesired frequency within a particular band, a switch 512 coupled to front end 514 and operable to selectively bypass notch filter 508, and an output filter 510 operable to attenuate signals outside the desired frequency range.

In the illustrated example, front end 514 includes a first stage 502 coupled to one of the windings of magnetic sensor 200 and operable to receive the induced signal from magnetic sensor 200. First stage 502 may comprise any appropriate electronics device capable of comparing the fields induced within magnetic sensor 200 to another constant source. For example, first stage 502 may comprise a differential operational amplifier that compares the induced fields to ground. In another embodiment, first stage 502 comprises a differential amplifier capable of producing a substantially flat output response. In this example, first stage 502 comprises an LT 1028 low-noise differential operational amplifier that compares the induced field to ground and produces a substantially flat output response from approximately 80 Hz and above.

A feedback resistor 504 is coupled between one of the windings of magnetic sensor 200 and the output of first stage 502. Feedback resistor 504 may be selected to achieve the desired output response from first stage 502. The impedance of each winding of magnetic sensor 200 and the characteristics of first stage 502 contribute to determining the value and characteristics of feedback resistor 504. In this example, feedback resistor comprises a 490-ohm resistor.

A second stage 506 can be coupled to first stage 502 and operate to increase the magnitude of the output signal of first stage 502. Second stage 506 may comprise any electrical device capable of producing a gain between an input signal and an output signal. For example, second stage 506 may comprise a constant gain operational amplifier. In this example, second stage 506 comprises an LT 1128 low-noise constant gain operational amplifier capable of producing a constant 30 dB gain independent of input frequency.

Notch filter 508 may comprise any appropriate filter device capable of substantially attenuating frequencies within a particular frequency band and substantially passing frequencies outside that particular band. Where, for example, antenna 100 operates to collect low frequency signals in an environment consisting of power lines, it may be desirable to pass low frequency signals while eliminating noise from the power lines. Notch filter 508 can comprise a filter device operable to substantially attenuate frequency signals attributable to, for example, power lines and to pass desired frequencies. In this example, notch filter 508 can selectively attenuate the 50 Hz or 60 Hz frequencies from the induced signal.

Switch 512 may comprise any device capable of removing at least a portion of an electrical circuit from operation. In one embodiment, switch 512 can receive a signal from control module 406 to remove notch filter 508 from signal conditioning channel 550. In this example, switch 512 comprises a relay 516 activated from control module 406 and operable to bypass notch filter 508.

Output filter 510 may comprise any filter device capable of attenuating signals outside the desired frequency range. In this example, butterworth filter comprises an eight-pole active butterworth filter that has a roll-off at 8000 Hz at 80 dB/octave.

Figure 6:
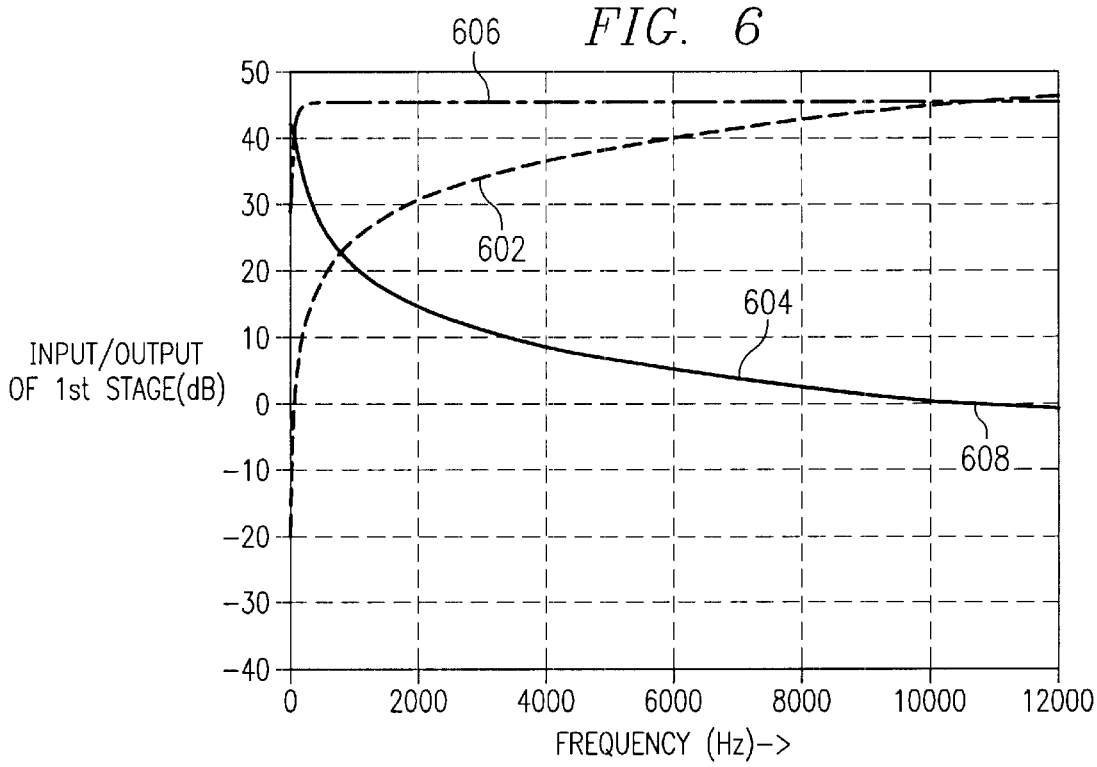
FIG. 6 is a graphic representation of sample characteristics of one embodiment of a first stage as a function of input/output signal magnitude and frequency.

FIG. 6 is a graphic representation of sample characteristics of one embodiment of first stage 502 as a function of input/output signal magnitude and frequency. This graph shows the induced input signal 602 increasing with frequency and the gain 604 decreasing with frequency. The resulting output signal 606 is substantially flat from at least 80 Hz and above. In this example, input signal 602 comprises the signal induced within the windings of magnetic sensor 200.

One characteristic of first stage 502 comprises a gain 604 that rolls off, at a substantially similar rate, as the frequency of input signal 602 increases. The reduction in the gain of first stage 502 as the frequency of input signal 602 increases provides a substantially flat output signal 606 as a function of frequency. Another characteristic of first stage 502 comprises the attenuation of out-of-band signals above, for example, 11.5 kHz where the gain 604 drops to 0 dB 608 and continues to drop for higher frequencies.

Figure 7:
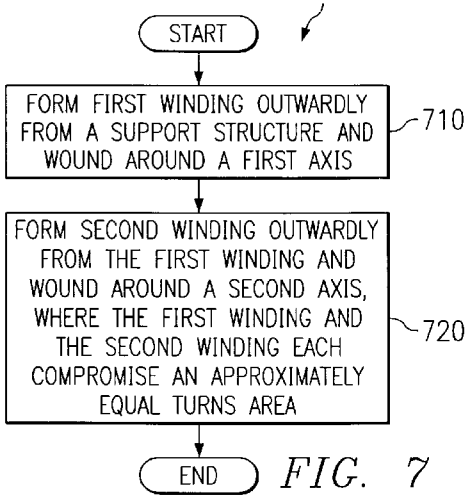
FIG. 7 is flow chart showing one example of a method of forming magnetic loop antenna according to the teachings of the present invention.

FIG. 7 is a flow chart showing one exemplary method 700 of forming magnetic loop antenna 100. In one particular embodiment, magnetic sensor 200 may be formed in accordance with the embodiment depicted in FIG. 2. In this example, method 700 begins at step 710 by forming a first winding 206 outwardly from a support structure 202 around a first axis 216. In some embodiments, first winding 206 is wound a number of turns $\mathbf{206}_{a\text{-}n}$ around a first plurality of spacers 204 disposed inwardly from at least two opposing sides of first winding 206. In other embodiments, first winding 206 is wound directly around support structure 202. In this particular example, first winding 206 comprises 18 AWG laminated copper wire wound 280 turns around a twelve inch by thirteen inch turns area.

A second winding 210 is formed at step 720 outwardly from first winding 206 around a second axis 218 that is substantially orthogonal to first axis 216. In some embodiments, second winding 210 is wound a number of turns $\mathbf{210}_{a\text{-}m}$ around second plurality of spacers 208 disposed inwardly from at least two opposing sides of second winding 210. In that embodiment, spacers 208 reside outwardly from two opposing sides of first winding 206 and inwardly from at least two opposing sides of second winding 210, where first winding 206 and second winding 210 overlap. In this particular example, second winding 210 comprises 18 AWG laminated copper wire wound 280 turns around a twelve inch by thirteen inch turns area. In that example, first winding 206 and second winding 210 are wound around an approximately equal turns area.

A third winding 214 is formed outwardly from support structure 202 around a third axis 220 that is substantially orthogonal to first axis 216 and second axis 218. Third winding can be formed inward or outward from first winding and second winding. In some embodiments, third winding 214 is wound a number of turns $\mathbf{214}_{a\text{-}w}$ around third plurality of spacers 212 and fourth plurality of spacers 215. In that embodiment, spacers 212 are disposed inwardly from four sides of third winding 214 and spacers 215 are disposed inwardly from two opposing sides of third winding 214 where third winding 214 and second winding 210 overlap. In this particular example, third winding 214 comprises 18 AWG laminated copper wire wound 280 turns around a fourteen inch by fourteen inch turns area.

In a particular embodiment, filter shield 250 is formed outwardly from magnetic sensor 200. In one particular embodiment, filter shield 250 may be formed in accordance with the embodiment depicted in FIG. 3. In this example, filter shield 250 comprises forming a first shield winding 252 around first axis 216 outwardly from magnetic sensor 200, forming a second shield winding 256 around second axis 218 outwardly from first shield winding 252, and forming a third shield winding 260 around third axis 220 outwardly from second shield winding 256. In that example, shield windings 252, 256, and 260 comprise metallic tape, and axes 216, 218, and 220 are all substantially orthogonal to each other.

Although the present invention has been described in several embodiments, a myriad of changes, variations, alterations, transformations, and modifications may be suggested to one skilled in the art, and it is intended that the present invention encompass such changes, variations, alterations, transformations, and modifications as falling within the spirit and scope of the appended claims.

What is claimed is:

1. An antenna operable to collect sub-high frequency radio signals, the antenna comprising:

a three dimensional support structure, a first winding disposed outwardly from the three dimensional support structure and wound around a first axis of the three dimensional support structure; and a second winding disposed outwardly from the three dimensional support structure and the first winding and wound around a second axis orthogonal to the first axis of the three dimensional support structure;

wherein the first winding and the second winding each comprise an approximately equal turns area, and wherein the approximately equal turns area is defined by a combination of a dimension of the three dimensional support structure and a dimension of a plurality of spacers disposed outwardly from at least two opposing sides of the three dimensional support structure.

2. The antenna of claim 1, wherein the first winding is wound around the plurality of spacers.

3. The antenna of claim 1, wherein the plurality of spacers are disposed outwardly from at least two opposing sides of the first winding where the first winding and the second winding overlap, and wherein the second winding is wound around the plurality of spacers.

4. The antenna of claim 3, wherein each of the plurality of spacers comprises a decoupling member coupled to ground and operable to reduce cross-talk between the first winding and the second winding.

5. The antenna of claim 1, wherein the first axis comprises a horizontal axis and the second axis comprises a horizontal axis.

6. The antenna of claim 1, wherein the first axis comprises a horizontal axis and the second axis comprises a vertical axis.

7. The antenna of claim 1, wherein the three dimensional support structure comprises a substantially cubic support structure.

8. The antenna of claim 1, further comprising a third winding disposed outwardly from the three dimensional support structure and wound around a third axis orthogonal to the first axis and the second axis of the three dimensional support structure.

9. The antenna of claim 8, wherein the third winding is disposed outwardly from the second winding.

10. The antenna of claim 8, wherein the third winding is disposed inwardly from the first winding.

11. The antenna of claim 1, further comprising a filter shield disposed outwardly from the second winding and operable to attenuate a portion of a frequency signal collected by the first winding or the second winding.

12. The antenna of claim 11, wherein the filter shield comprises:

a first shield winding disposed outwardly from the second winding and wound around one of the axes of the three dimensional support structure;

a second shield winding disposed outwardly from the first shield winding and wound around another of the axes of the three dimensional support structure and orthogonal to the one of the axes of the three dimensional support structure; and a third shield winding disposed outwardly from the second shield winding and wound around yet another of the axes of the three dimensional support structure and orthogonal to the one of the axes of the three dimensional support structure and the another of the axes of the three dimensional support structure;

wherein the first shield winding, second shield winding, and the third shield winding each comprise metallic tape.

13. The antenna of claim 1, further comprising an electronics module coupled to the first winding or the second winding operable to transmit an output response to a communications module, the electronics module comprising a single differential operational amplifier operable to receive all signals from an associated winding.

14. The antenna of claim 1, further comprising an electronics module operable to receive a control signal to affect a mode of operation of the antenna.

15. The antenna of claim 14, wherein the electronics module comprises a notch filter and wherein the control signal is operable to selectively bypass the notch filter.

16. A method of forming an antenna operable to collect sub-high frequency radio signals, the method comprising:

forming a first winding disposed outwardly from a three dimensional support structure and wound around a first axis of the three dimensional support structure;

forming a second winding disposed outwardly from the three dimensional support structure and the first winding and wound around a second axis orthogonal to the first axis of the three dimensional support structure; and wherein the first winding and the second winding each comprise an approximately equal turns area, and wherein the approximately equal turns area is defined by a combination of a dimension of the three dimensional support structure and a dimension of a plurality of spacers disposed outwardly from at least two opposing sides of the three dimensional support structure.

17. The method of claim 16, wherein the first winding is wound around the plurality of spacers.

18. The method of claim 16, wherein the plurality of spacers are disposed outwardly from at least two opposing sides of the first winding where the first winding and the second winding overlap, and wherein the second winding is wound around the plurality of spacers.

19. The method of claim 18, wherein each of the plurality of spacers comprises a decoupling sheet operable to reduce cross-talk between the first winding and the second winding.

20. The method of claim 16, wherein the first axis comprises a horizontal axis and the second axis comprises a horizontal axis.

21. The method of claim 16, wherein the first axis comprises a horizontal axis and the second axis comprises a vertical axis.

22. The method of claim 16, wherein the three dimensional support structure comprises a substantially cubic support structure.

23. The method of claim 16, further comprising forming a third winding disposed outwardly from the three dimensional support structure and wound around a third axis orthogonal to the first axis and the second axis of the three dimensional support structure.

24. The method of claim 23, wherein the third winding is disposed outwardly from the second winding.

25. The method of claim 23, wherein the third winding is disposed inwardly from the first winding.

26. The method of claim 16, further comprising forming a filter shield disposed outwardly from the second winding and operable to attenuate a portion of a frequency signal collected by the first winding or the second winding.

27. The method of claim 26, wherein the filter shield comprises:

forming a first shield winding disposed outwardly from the second winding and wound around one of the axes of the three dimensional support structure;

forming a second shield winding disposed outwardly from the first shield winding and wound around another of the axes of the three dimensional support structure and orthogonal to the one of the axes of the three dimensional support structure; and forming a third shield winding disposed outwardly from the second shield winding and wound around yet another of the axes of the three dimensional support structure and orthogonal to the one of the axes of the three dimensional support structure and the another of the axes of the three dimensional support structure;

wherein the first shield winding, second shield winding, and the third shield winding each comprise metallic tape.

28. An antenna operable to collect sub-high frequency radio signals, the antenna comprising:

a three dimensional support structure;

a first winding disposed outwardly from the three dimensional support structure and wound around a first axis of the three dimensional support structure;

a second winding disposed outwardly from the three dimensional support structure and the first winding -and wound around a second axis orthogonal to the first axis of the three dimensional support structure, wherein the first winding and the second winding each comprise an approximately equal turns area; and a filter shield disposed outwardly from the second winding and operable to attenuate a portion of a frequency signal collected by the first winding or the second winding.

29. The antenna of claim 28, wherein the approximately equal turns area is defined by a combination of a dimension of the three dimensional support structure and a dimension of a plurality of spacers disposed outwardly from at least two opposing sides of the three dimensional support structure.

30. The antenna of claim 28, wherein the filter shield comprises:

a first shield winding disposed outwardly from the second winding and wound around one of the axes of the three dimensional support structure;

a second shield winding disposed outwardly from the first shield winding and wound around another of the axes of the three dimensional support structure and orthogonal to the one of the axes of the three dimensional support structure; and a third shield winding disposed outwardly from the second shield winding and wound around yet another of the axes of the three dimensional support structure and orthogonal to the one of the axes of the three dimensional support structure and the another of the axes of the three dimensional support structure;

wherein the first shield winding, second shield winding, and the third shield winding each comprise metallic tape.

31. The antenna of claim 28, further comprising a first plurality of spacers disposed outwardly from at least two opposing sides of the three dimensional support structure, and wherein the first winding is wound around the plurality of spacers.

32. The antenna of claim 28, further comprising a second plurality of spacers disposed outwardly from at least two opposing sides of the first winding where the first winding and the second winding overlap, and wherein the second winding is wound around the second plurality of spacers.

33. A method of forming an antenna operable to collect sub-high frequency radio signals, the method comprising:

forming a first winding disposed outwardly from a three dimensional support structure and wound around a first axis of the three dimensional support structure;

forming a second winding disposed outwardly from the three dimensional support structure and the first winding and wound around a second axis orthogonal to the first axis of the three dimensional support structure, wherein the first winding and the second winding each comprise an approximately equal turns area; and forming a filter shield disposed outwardly from the second winding and operable to attenuate a portion of a frequency signal collected by the first winding or the second winding.

34. The method of claim 33, wherein the approximately equal turns area is defined by a combination of a dimension of the three dimensional support structure and a dimension of a plurality of spacers disposed outwardly from at least two opposing sides of the three dimensional support structure.

35. The method of claim 33, wherein the filter shield comprises:

forming a first shield winding disposed outwardly from the second winding and wound around one of the axes of the three dimensional support structure;

forming a second shield winding disposed outwardly from the first shield winding and wound around another of the axes of the three dimensional support structure and orthogonal to the one of the axes of the three dimensional support structure; and forming a third shield winding disposed outwardly from the second shield winding and wound around yet another of the axes of the three dimensional support structure and orthogonal to the one of the axes of the three dimensional support structure and the another of the axes of the three dimensional support structure;

wherein the first shield winding, second shield winding, and the third shield winding each comprise metallic tape.

36. The method of claim 33, further comprising disposing a first plurality of spacers outwardly from at least two opposing sides of the three dimensional support structure, and wherein the first winding is wound around the first plurality of spacers.

37. The method of claim 33, further comprising disposing a second plurality of spacers outwardly from at least two opposing sides of the first winding where the first winding and the second winding overlap, and wherein the second winding is wound around the second plurality of spacers.

* * * * *